US005332024A

United States Patent [19]

Fasano

[11] Patent Number: 5,332,024

[45] Date of Patent: Jul. 26, 1994

[54] MULTIPURPOSE MOLD

[75] Inventor: Fulvio Fasano, Udine, Italy

[73] Assignee: Danieli & C. Officine Meccaniche SpA, Buttrio, Italy

[21] Appl. No.: 845,657

[22] Filed: Mar. 4, 1992

[30] Foreign Application Priority Data

Mar. 5, 1991 [IT] Italy ..... UD91 A 000029

[51] Int. Cl.[5] ..... B22D 11/16

[52] U.S. Cl. ..... 164/449.1; 164/504; 164/154.1

[58] Field of Search ..... 164/150, 154, 155, 449, 164/504

[56] References Cited

U.S. PATENT DOCUMENTS

| | | | |
|---|---|---|---|
| 3,456,715 | 7/1969 | Freedman | 164/150 |
| 3,834,445 | 9/1974 | Raschke | 164/150 |
| 3,837,390 | 9/1974 | Bode | 164/416 |
| 4,651,800 | 3/1987 | Kollberg | 164/150 |
| 4,739,819 | 4/1988 | Eriksson | 164/150 |
| 5,072,774 | 12/1991 | Schilcher | 164/150 |

FOREIGN PATENT DOCUMENTS

| | | | |
|---|---|---|---|
| 0063072 | 10/1982 | European Pat. Off. | 164/150 |
| A0102345 | 3/1984 | European Pat. Off. . | |
| A0117115 | 8/1984 | European Pat. Off. . | |
| A2139051 | 2/1973 | Fed. Rep. of Germany . | |
| 58-050157 | 3/1983 | Japan . | |

OTHER PUBLICATIONS

Regelungs-Technische Praxis, pp. 176-180-Rodder.

*Primary Examiner*—P. Austin Bradley
*Assistant Examiner*—Rex E. Pelto
*Attorney, Agent, or Firm*—Antonelli, Terry, Stout & Kraus

[57] ABSTRACT

Multipurpose mold (10) which cooperates with a discharge roller conveyor (13) having a first removable segment (14) and which can cooperate with an electromagnetic stirrer (21) and also can form part of a plurality of casting lines. The mold (10) includes one or more level control systems (24–25) to control the level of liquid metal, a crystallizer (16), a jacket (18) defining an interspace (50) for the accelerated flow of a cooling fluid, an outer sidewall (19) to form at least one chamber (17) and a closure bottom (22). The outer sidewall (19) has at least in its second lower part a substantially circular enclosure (20) for the external lodgement of the electromagnetic stirrer (21) supported and positioned on the closure bottom (22). The closure bottom (22) has at its lower end positioner (34) mating with positioning guide-block supports (36) included substantially above the first removable segment (14). The closure bottom (22) includes in its lower portion an attachment (41) cooperating with connection means (55) provided substantially above the first removable segment (14).

12 Claims, 3 Drawing Sheets

MULTIPURPOSE MOLD

BACKGROUND OF THE INVENTION

This invention concerns a multipurpose ingot mould. To be more exact, the mould of this invention is employed in plants performing the continuous casting of liquid metal and is generally positioned downstream of a tundish and upstream of a discharge roller conveyor.

The mould according to this invention can be combined with other analogous or identical moulds to form a plurality of continuous casting lines.

Continuous casting moulds can be of a vertical, curved or almost horizontal type.

Continuous casting moulds generally consist of a crystallizer made of copper or a copper alloy through which passes the liquid metal arriving from a tundish and which, at start-up, cooperates with a sliding bottom, on which are fitted pinetree-shaped means that become anchored to the cast liquid metal.

The sliding bottom is connected to a starter bar cooperating with a discharge roller conveyor located downstream of the mould so as to draw the ingot being formed.

It is known that the ingots being formed and leaving the mould are further cooled by suitable cooling means consisting normally of sprayers that spray a cooling liquid, normally water, and hit the ingot being formed directly.

Continuous casting moulds comprise systems to measure and check the level of liquid metal in the crystallizers; these measurement systems have the purpose of preventing overflowing or a nee low level of the liquid metal.

An electromagnetic stirrer may be fitted in these moulds to make homogeneous the molten metal in the mould.

In the moulds of the state of the art the cleaning and maintenance work causes a great loss of time and a resulting reduction in the output of the mould.

Moreover, the known moulds form an obstacle to the electromagnetic flow of the stirrer and include unsuitable means to control the level of the metal.

Furthermore, the operations to replace and maintain the moulds and the first segment of the discharge rollers entail technical problems and a great loss of time.

Besides, the replacement of all the moulds in a plurality of continuous casting lines takes place mould by mould with a great loss of time and energy.

Moreover, the re-positioning of the moulds on their relative roller conveyors involves problems of alignment and correct positioning.

Also, the inclusion or not of the electromagnetic stirrer affects the mould itself, which has to be wholly replaced.

To obviate these shortcomings of the state of the art and to achieve further advantages, the present applicant has designed, tested and embodied this invention.

SUMMARY OF THE INVENTION

This invention enables a mould to be provided which is already pre-arranged for a swift and practical installation of a possible electromagnetic stirrer.

According to the invention the mould comprises in the zone where the electromagnetic stirrer works or will work at least one screen to divert and convey the cooling fluid; this screen consists of a non-magnetic material located between the stirrer and the crystallizer so as to reduce to a minimum the disturbances of the electromagnetic flow of the stirrer.

The mould of this invention comprises also at least one system to control the level of liquid metal, this system being of a magnetic and/or radioactive type.

These control systems may work alone or in combination, so that they make possible a start-up of the mould in an automatic sequence, that is to say, the beginning of the removal and extraction of the pinetree-shaped means as soon as the level of molten metal in the crystallizer reaches the desired value.

Where the control system is of a radioactive type, the metallic elements located between the suitably screened radioactive source and the radioactive monitor comprise suitable slimming grooves at the area of the passage of radioactive flow so as to lessen the screening effect of those elements and thus to increase the sensitiveness of the system.

Where the control system is of a magnetic type, the magnetic monitor is placed near the outer sidewall of the crystallizer without screens in between.

The mould according to this invention is also suitable to be combined with extractor means which enable one single mould to be extracted or two or more moulds of two or more casting lines to be extracted at the same time so that the operations of extraction and re-installation can be carried out simply, swiftly and economically. This combination assists maintenance operations away from the rolling line.

Furthermore, the mould according to this invention comprises positioning and automatic alignment means which facilitate the alignment of the mould with the discharge roller conveyor during the installation or re-installation of the mould.

According to a variant the mould of the invention comprises attachment means that cooperate with the first removable segment of the discharge roller conveyor so as to enable the mould and that segment to be removed and refitted at one and the same time for maintenance and adjustment.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 2:
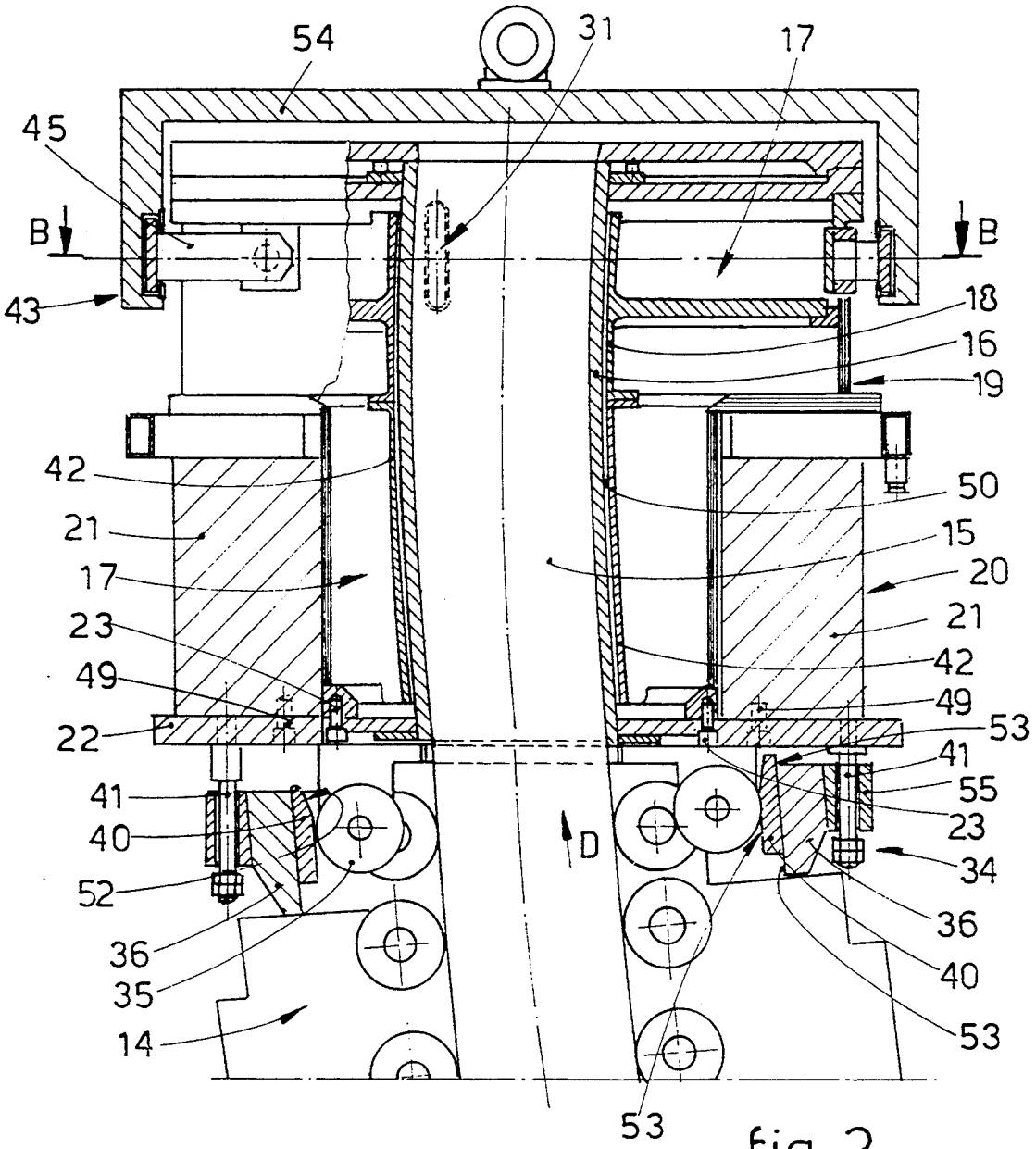
FIG. 2 is a vertical lengthwise section of a mould according to this invention along the line A—A of FIG. 3.
Figure 1:
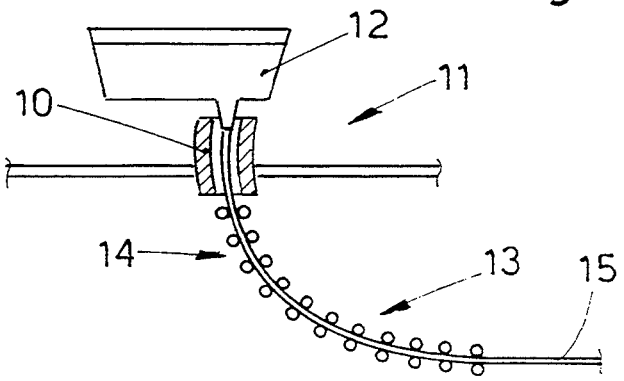
FIG. 1 is a diagrammatic side view of a curved continuous casting plant.
Figure 3:
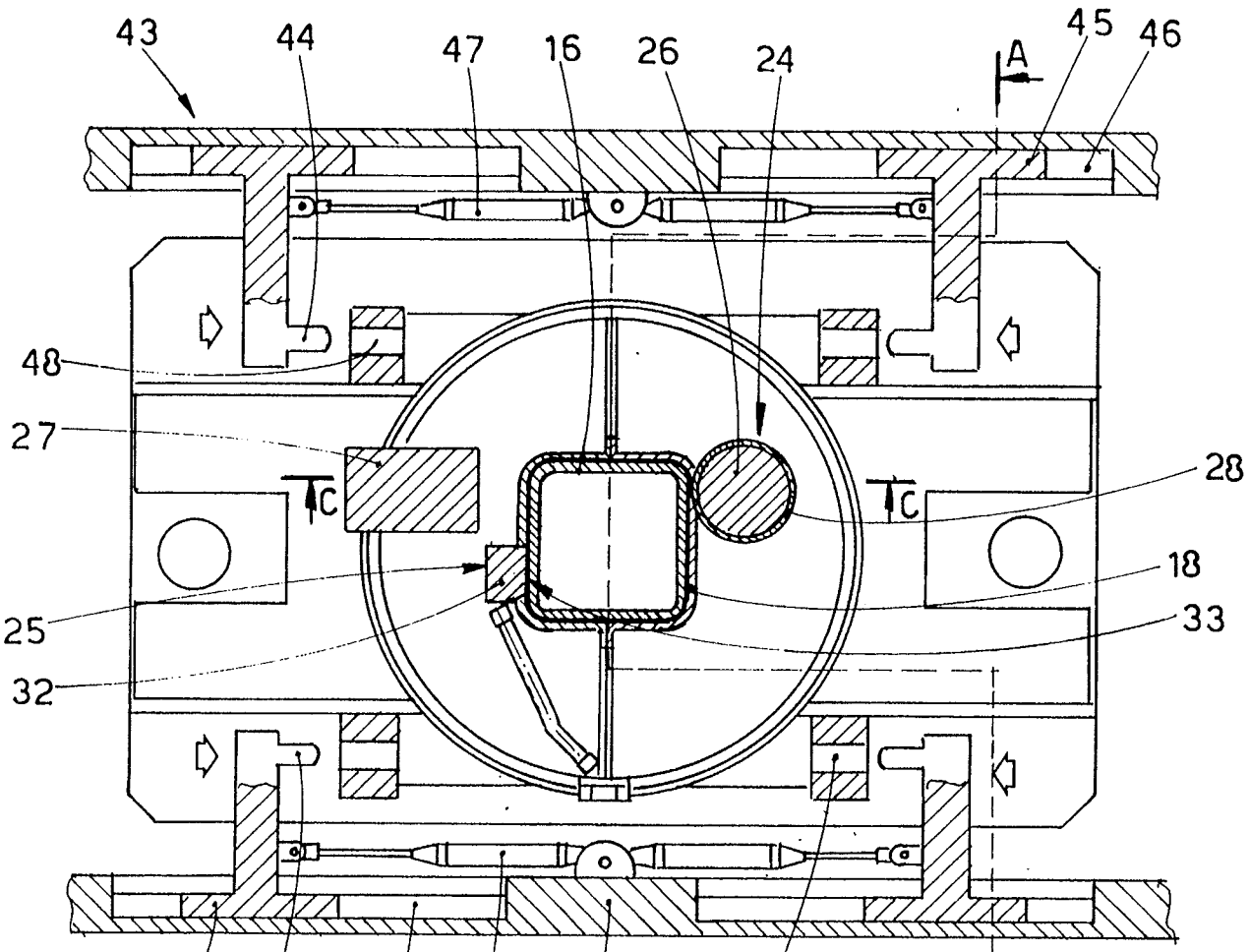
FIG. 3 is a section of the mould to FIG. 2 along the line B—B of FIG. 2.
Figure 4:
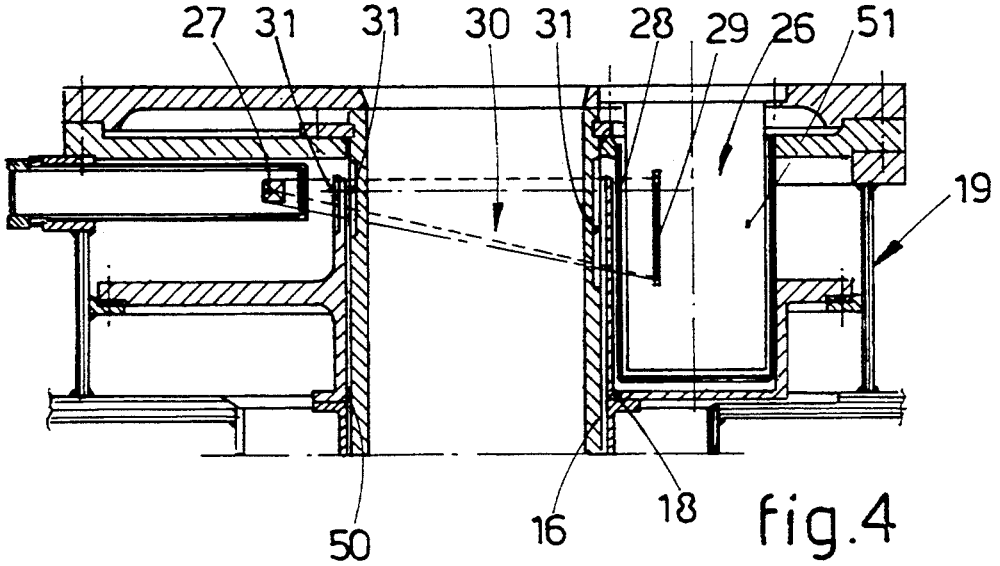
FIG. 4 is a section of the mould of FIG. 2 along the line C—C of FIG. 3.
Figure 5:
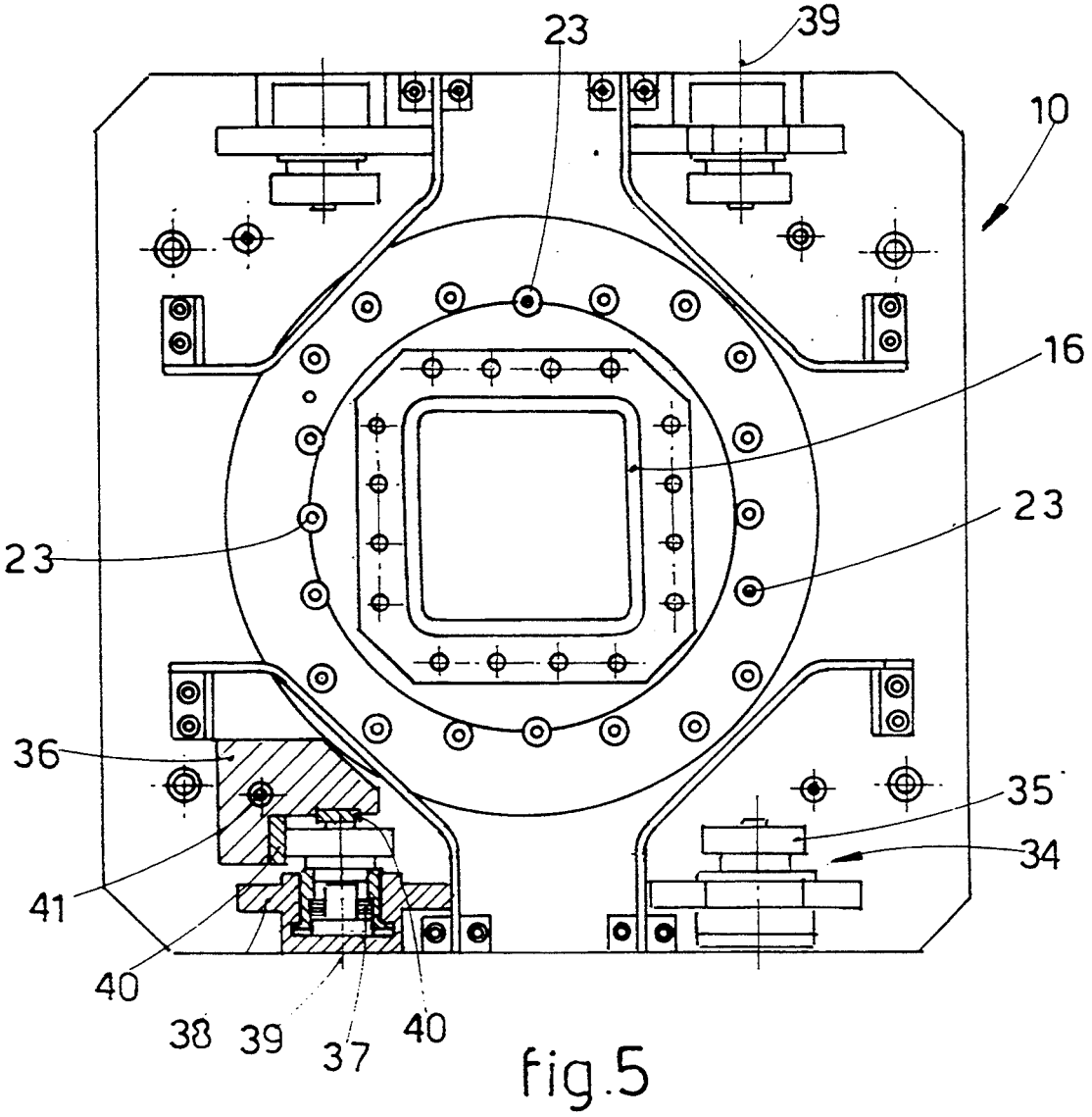
FIG. 5 is a view of the mould of FIG. 2 from below according to the arrow D.

In the figures a mould according to this invention is generally referenced with the number 10.

A continuous casting plant 11 comprises in this example the curved mould 10 positioned immediately below a tundish 12 and upstream of a discharge roller conveyor 13 which includes a first removable segment 14 for quicker maintenance work.

The molten metal slides in crystallizers 16, solidifies and is withdrawn continuously in the form of a continuous ingot 15.

The crystallizer 16, which in this case has a substantially square cross section, is solidly fixed to a chamber 17.

In this example the crystallizer 16 is cooled by a cooling liquid, normally water, which passes through an interspace 50 between a jacket 18 and the crystallizer 16; collection and distribution chambers defined by an outer sidewall 19 of the chamber 17 are included.

The chamber 17 comprises in its lower second portion a substantially circular enclosure 20 within which a possible electromagnetic stirrer 21 suitable to make homogeneous the molten metal in the crystallizer 16 can be positioned.

With such an embodiment the mould 10 can work with or without the electromagnetic stirrer 21, a considerable liquid cooling mass being present in correspondence with the upper zone of the crystallizer 16 where completely liquid metal is located.

The lower part of the chamber 17 is closed by a bottom 22, which bears the crystallizer 16 and can be readily dismantled from, and connected to, the chamber 17 by anchorage means, which in this case are a plurality of bolts 23 arranged along the perimeter of the bottom 22.

The installation of the possible electromagnetic stirrer 21 on the mould 10 is carried out by dismantling the bottom 22 and inserting the electromagnetic stirrer 21 into the circular enclosure 20 from below.

Removal of the bottom 22 causes removal of the crystallizer 16 too, which is secured to the bottom 22 by appropriate bolts.

When the whole assembly has been re-installed, the stirrer 21 is thus held within the circular enclosure 20 and supported by the bottom 22, where the stirrer 21 is secured in this example by a plurality of bolts 49.

At least the part of the jacket 18 corresponding to the electromagnetic stirrer 21 consists adantageously of a non-magnetic material 42 so as to reduce to a minimum the disturbances caused by the jacket 18 to the electromagnetic field generated by the electromagnetic stirrer 21.

In this example the mould 10 shown in the figures is equipped with two systems to control the level of liquid metal; these systems are respectively of a radioactive type 24 and a magnetic type 25, which can operate by themselves alone or in combination so as to optimize the control of the level of liquid metal in the crystallizer 16.

By means of these level control systems 24–25 it is possible to get accurate information so as to be able to control with certainty in an automatic manner the start-up of a new casting operation as soon as the liquid metal has reached the desired level in the crystallizer 16.

The level control system of a radioactive type 24 comprises in this case at least one radioactive source 26 and at least one radioactive monitor 27 cooperating with each other, the crystallizer 16 being located between them.

In this example the radioactive source 26 is located within an upwardly open container 28, which has the purpose of holding and positioning the radioactive source 26 and its screen 51.

A vertical lengthwise slit 29 is machined in the screen 51 at about the level of the molten metal in the crystallizer 16. A radioactive monitor 27 too cope rates at about the level of the molten metal.

Radiations 30 emerge through the vertical lengthwise slit 29 and are picked up by the radioactive monitor 27 with regard to the actual position of the level of the molten metal.

Both the crystallizer 16 and the jacket 18 have their thickness suitably reduced 31 in correspondence with the zone of the radioactive flow 30 so as to lessen their screening effect, thus enabling a radioactive source 26 of a reduced capacity to be used without affecting the results.

In this example the level control system of a magnetic type 25 comprises a magnetic monitor system 32 fitted solidly to the jacket 18.

In this case the jacket 18 comprises, in correspondence with the magnetic monitor 32, an opening 33 of a form mating with the magnetic monitor 32; the magnetic monitor 32 is inserted into the opening 33 so as to face the crystallizer 16 directly, thus reducing to a minimum the disturbances of the magnetic flow.

The mould 10 includes positioning and alignment means 34 which facilitate the positioning and make possible the alignment of the mould 10 with the removal roller conveyor 13 and in particular with the first removable segment 14 thereof.

The positioning means 34 in this example comprise guide rollers 35 connected to the bottom 22 and arranged in such a way that they can cooperate with guide-block supports 36 secured to the removal roller conveyor 13.

Suitable springs cooperate with the guide rollers 35 and in this example consist of cup springs 37 positioned within a connecting casing 38 rigidly connected to the bottom 22.

The cup springs 37 enable the guide rollers 35 to be displaced axially and resiliently along the axis 39 so as to assist the positioning and alignment of the mould 10 on the removal roller conveyor 13.

The guide-block supports 36 comprise suitable guide-blocks 40, which cooperate with the guide rollers 35 and include bevels 52 to provide a lead-in and alignment.

These guide-blocks 40 comprise a slide tract 53 to enable the guide rollers 35 to run as a result of the substantially vertical movement of oscillation, well known in the state of the art, of the mould 10.

The guide-block supports 36 may be connected to the bottom 22 by suitable attachment means consisting of bolts 41 in this case. The bolts 41 are free to move axially within connection means 55 solidly fixed to the guide-block supports 36 so as to follow the oscillation of the mould 10 without coming into contact with the removal roller conveyor 13.

In this way, when the mould 10 is removed, the first removable segment 14 of the removal roller conveyor 13 can be removed therewith for maintenance.

Extractor means 43 cooperate with the mould 10 and enable one single mould 10 to be withdrawn or two or more moulds of two or more casting lines to be withdrawn at one and the same time.

The extractor means 43 include pins 44 solidly fitted in this case to movable carriages 45, which, being actuated by suitable actuators 47, move on suitable guides 46 firmly secured to a connecting plate 54. Four of these carriages 45 cooperate with each mould 10 in this example.

The carriages 45 are displaced in such a way so to make the respective pins 44 cooperate simultaneously with holes 48 fixed to the mould 10 and included on the outside of the chamber 17 and balanced in relation to the crystallizer 16.

According to a variant the connecting plate 54 of the extractor means 43 can act on a plurality of moulds 10 at the same time so as to enable the moulds 10 to be withdrawn at the same time with or without the first removable segment 14 of the respective removal roller conveyor 13.

What is claimed is:

1. A multipurpose mold which cooperates at its lower end with a discharge roller conveyor having a first removable segment, comprising:

a longitudinally extending crystallizer;

at least one level control system for controlling a level of liquid metal in said crystallizer;

a jacket surrounding and spaced from said crystallizer for at least a portion of a length of said crystallizer, said jacket and said crystallizer defining an interspace, said interspace being means for accelerated flow of cooling fluid;

an outer sidewall forming at least one chamber around said jacket and crystallizer, at least a lower part of said outer sidewall comprising a substantially circular enclosure defining a space, said space being means for providing an electromagnetic stirrer therein;

a closure bottom, said closure bottom being means for operatively closing a lower end of said space and being means for supporting thereon said electromagnetic stirrer;

a positioner provided at a lower portion of said closure bottom, said positioner being means for positioning and alignment of said mold with a guide positioned substantially above said first removable segment of said discharge roller conveyor; and attachment means for attaching said mold to a connection means positioned substantially above said first removable segment of said discharge roller conveyor, wherein the attachment means is provided at a lower portion of said closure bottom.

2. Mould as claimed in claim 1, wherein said at least one level control system includes a radioactive type level controller to control the level of the liquid metal, said radioactive type level controller comprising an upwardly open container extending lengthwise substantially parallel to the crystallizer and containing a radioactive source and a radioactive monitor spaced from said radioactive source with said crystallizer being positioned therebetween, at least the crystallizer including reductions of its thickness in cooperation with an area of passage of radioactive flow from said radioactive source to said radioactive monitor.

3. Mould as claimed in claim 1, wherein said at least one level control system includes a magnetic type level indicator to control the level of the liquid metal said magnetic type level indicator comprising a magnetic monitor fixed to said jacket, wherein the jacket comprises an opening mating with the frontal external periphery of the magnetic monitor.

4. Mould as claimed in claim 1, in which the jacket consists of a non-magnetic material at least in its segment mating with the substantially circular enclosure.

5. Mould as claimed in claim 1, in which the bottom supports and positions the crystallizer.

6. Mould a claimed in claim 1, in which the positioner comprises at least one guide roller arranged to cooperate with at least one guide-block support of said guide of said discharge roller conveyor, said guide block support having an initial bevelled lead-in segment.

7. Mould as claimed in claim 6, in which each guide-block support comprises a linear slide segment and wherein each guide roller cooperates with each linear slide segment to allow for oscillation of the crystallizer.

8. Mould (10) as claimed in claim 1, in which the attachment means can move axially by a determined value in the connection means.

9. Mould as claimed in claim 1, further comprising at least two attachment and supporting holes for connection to extractor means.

10. Mould as claimed in claim 9, in which the extractor means comprise pins able to move axially along the holes.

11. Mould as claimed in claim 9, in which the extractor means cooperate with a plurality of moulds at one and the same time.

12. A mold as claimed in claim 1, further comprising said electromagnetic stirrer provided within said enclosure and supported on said closure bottom.

* * * * *